US005911249A

United States Patent [19]

Sanfilippo et al.

[11] Patent Number: 5,911,249

[45] Date of Patent: Jun. 15, 1999

[54] GASSING RAIL APPARATUS AND METHOD

[75] Inventors: James J. Sanfilippo, Chicago; John E. Sanfilippo, Barrington, both of Ill.

[73] Assignee: Jescorp, Inc., Des Plaines, Ill.

[21] Appl. No.: 08/816,389

[22] Filed: Mar. 13, 1997

[51] Int. Cl.[6] ..... B65B 31/00

[52] U.S. Cl. ..... 141/64; 141/63; 141/48; 141/70; 141/5; 141/11; 141/91; 141/92

[58] Field of Search ..... 141/5, 7, 11, 47–49, 141/63, 64, 70, 91, 92; 53/110, 432, 510

[56] References Cited

U.S. PATENT DOCUMENTS

| | | | |
|---|---|---|---|
| 268,477 | 12/1882 | Fish . | |
| 789,699 | 5/1905 | Lorenz . | |
| 1,406,380 | 2/1922 | Heath et al. . | |
| 1,639,828 | 8/1927 | Wheeler et al. . | |
| 1,928,903 | 10/1933 | Manning . | |
| 1,940,013 | 12/1933 | Petersen . | |
| 2,131,876 | 7/1938 | Hurst . | |
| 2,140,187 | 12/1938 | Kantor . | |
| 2,199,565 | 5/1940 | Kantor . | |
| 2,227,190 | 12/1940 | Kronquest . | |
| 2,240,655 | 5/1941 | Kronquest | 53/510 |
| 2,311,707 | 2/1943 | Stewart | 141/70 |
| 2,328,372 | 8/1943 | Wollenweber | 141/70 |
| 2,337,170 | 12/1943 | Wareham | 53/110 |
| 2,362,799 | 11/1944 | Boyd et al. | 53/432 |
| 2,439,773 | 4/1948 | Hohl et al. . | |
| 2,519,353 | 8/1950 | Cassady . | |
| 2,521,746 | 9/1950 | Preis . | |
| 2,630,958 | 3/1953 | Hohl | 53/407 |
| 2,649,671 | 8/1953 | Bartelt . | |
| 2,660,352 | 11/1953 | Renard | 141/70 |
| 2,768,487 | 10/1956 | Day et al. . | |
| 2,787,875 | 4/1957 | Johnson | 141/70 |
| 2,820,489 | 1/1958 | Day et al. | 141/7 |
| 2,830,415 | 4/1958 | Tiano | 53/510 |
| 2,854,039 | 9/1958 | Boyd et al. | 141/70 |
| 2,978,336 | 4/1961 | Morrison . | |
| 3,056,244 | 10/1962 | Bartels . | |
| 3,087,823 | 4/1963 | Hein et al. . | |

(List continued on next page.)

FOREIGN PATENT DOCUMENTS

| | | |
|---|---|---|
| 671525 | 8/1996 | Australia . |
| 689718 | 8/1998 | Australia . |
| 447131 | 3/1948 | Canada . |
| 463300 | 2/1950 | Canada . |
| 1309992 | 9/1989 | Canada . |
| 0 806 354 A1 | 7/1996 | European Pat. Off. . |
| 0 806 355 A1 | 5/1997 | European Pat. Off. . |
| 33 23 710 A1 | 10/1985 | Germany . |
| 0139313 | 5/1990 | Japan . |
| WO 95/31375 | 11/1995 | WIPO . |

OTHER PUBLICATIONS

Seven Sheets of Jescorp, Inc. Design Drawings Date: 1) Dec. 21, 1995; 2) B–Dec. 27, 1995; 3) B–Mar. 7, 1996; 4) C–Mar. 8, 1996; 5) Computer Printout Data Sheet (Jan. 15, 1996, p. 1 of 3); 6) Computer Printout Data Sheet (Jan. 15, 1996, p. 2 of 2); 7) Computer Printout Data Sheet (Jan. 10, 1996, p. 3 of 3).

*Primary Examiner*—J. Casimer Jacyna
*Attorney, Agent, or Firm*—Baniak Nicholas Pine & Gannon

[57] ABSTRACT

An apparatus for exposing product to a controlled environment includes a rail top, a rail base, and a longitudinally oriented gas limiting member including two sections connected at their longitudinal ends and providing a gap between the sections. The controlled environment gas may be provided to one longitudinal end of a baffle positioned in a channel region formed in the rail top. The gas is distributed along a longitudinally oriented baffle which is aligned with a gassing element positioned in the rail base. A T-shaped port block may be attached to the rail top and engage with a bracket and adjustment member for positioning.

24 Claims, 4 Drawing Sheets

U.S. PATENT DOCUMENTS 3,092,153 6/1963 Stoyke ..... 141/302
3,103,771 9/1963 Gräfingholt .
3,117,873 1/1964 Bartels et al. .
3,171,448 3/1965 Fromm ..... 141/302
3,220,153 11/1965 Cormack, Jr. et al. .
3,220,157 11/1965 Buchner .
3,340,668 9/1967 Bofinger .
3,347,534 10/1967 Dawson .
3,415,310 12/1968 Kulhmann .
3,466,841 9/1969 Rausing .
3,486,295 12/1969 Rausing et al. .
3,488,915 1/1970 Delestatius .
3,508,373 4/1970 Robinson, Jr. .
3,511,022 5/1970 Finley et al. .
3,545,160 12/1970 Jantze et al. .
3,584,661 6/1971 Riesenberg .
3,619,975 11/1971 Johnson et al. .
3,676,673 7/1972 Coleman .
3,747,296 7/1973 Zausner .
3,807,052 4/1974 Troue .
3,837,137 9/1974 Yatsushiro et al. .
3,860,047 1/1975 Finkelmeier et al. .
3,861,116 1/1975 Domke .
3,871,157 3/1975 Domke et al. ..... 53/110
3,881,300 5/1975 Zetterberg .
3,910,009 10/1975 Canfield .
3,936,950 2/1976 Troue .
3,939,287 2/1976 Orwig et al. .
3,942,301 3/1976 Domke .
4,014,153 3/1977 Wilson .
4,014,158 3/1977 Rausing .
4,016,705 4/1977 Wilson et al. .
4,027,450 6/1977 Chiu et al. .
4,094,121 6/1978 Ganholt .
4,140,159 2/1979 Domke ..... 141/129
4,148,933 4/1979 Janovtchik .
4,154,044 5/1979 Lang .
4,312,171 1/1982 Vadas ..... 53/510
4,458,734 7/1984 Scholle et al. .
4,498,508 2/1985 Scholle et al. .
4,588,000 5/1986 Malin et al. ..... 141/1
4,602,473 7/1986 Hayashi et al. ..... 53/510
4,658,566 4/1987 Sanfilippo ..... 53/432
4,696,226 9/1987 Witmer ..... 98/36
4,703,609 11/1987 Yoshida et al. .
4,707,334 11/1987 Gerhard ..... 422/28
4,733,818 3/1988 Aghnides .
4,763,683 8/1988 Carmack ..... 141/346
4,768,326 9/1988 Kovacs .
4,791,775 12/1988 Raque et al. ..... 53/510
4,823,680 4/1989 Nowotarski ..... 98/36
4,827,696 5/1989 Arends et al. .
4,831,811 5/1989 Nixon, Jr. et al. .
4,870,800 10/1989 Kasai ..... 53/88
4,881,580 11/1989 Murphy et al. ..... 141/346
4,905,454 3/1990 Sanfilippo et al. .
4,941,306 7/1990 Pfaffmann et al. .
4,962,777 10/1990 Bell ..... 134/63
4,964,259 10/1990 Yivisaker et al. .
4,982,555 1/1991 Ingemann .
4,996,071 2/1991 Bell .
5,001,878 3/1991 Sanfilippo et al. ..... 53/510
5,020,303 6/1991 Vokins .
5,054,265 10/1991 Perigo et al. .
5,069,020 12/1991 Sanfilippo et al. ..... 53/510
5,071,667 12/1991 Grüne et al. .
5,077,954 1/1992 Williams ..... 53/89
5,121,590 6/1992 Scanlan .
5,155,971 10/1992 Zopf .
5,159,799 11/1992 Rising et al. .
5,178,841 1/1993 Vokins et al. ..... 422/298
5,201,165 4/1993 Marano et al. ..... 53/510
5,228,269 7/1993 Sanfilippo et al. .
5,230,203 7/1993 Wu et al. .
5,247,746 9/1993 Johnson et al. .
5,323,589 6/1994 Linner .
5,371,998 12/1994 Johnson et al. .
5,417,255 5/1995 Sanfilippo et al. ..... 141/1
5,452,563 9/1995 Marano et al. ..... 53/432
5,473,860 12/1995 Linner .
5,486,383 1/1996 Nowotarski et al. .
5,488,811 2/1996 Wang et al. .
5,617,705 4/1997 Sanfilippo ..... 53/432
5,816,024 10/1998 Sanfilippo et al. .

FIG. 5
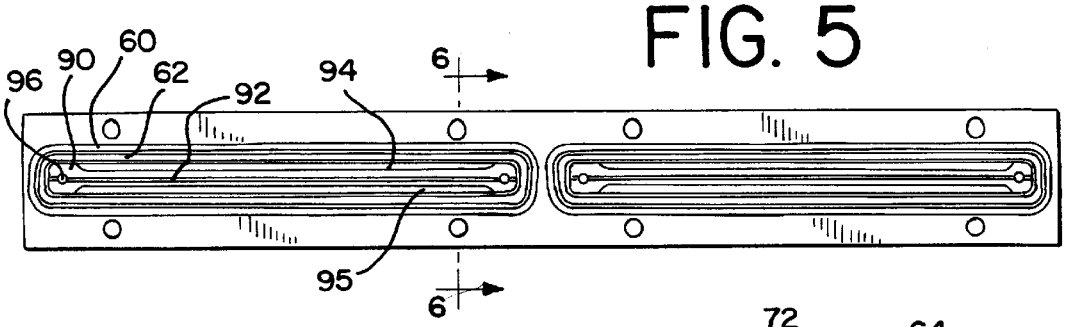
FIG. 6
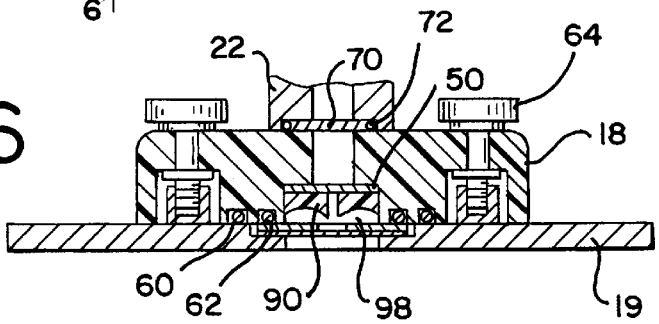
FIG. 7
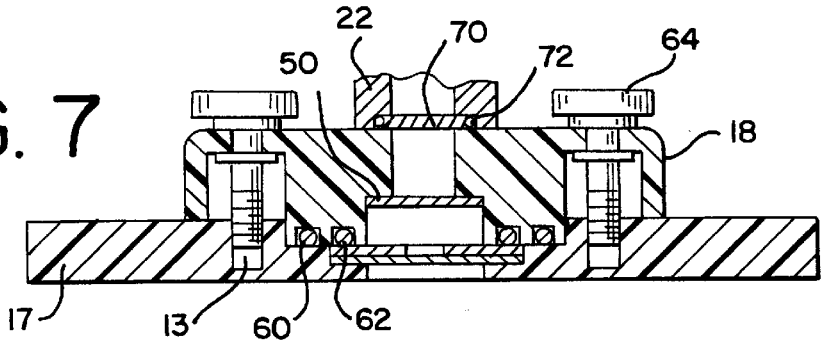
FIG. 8
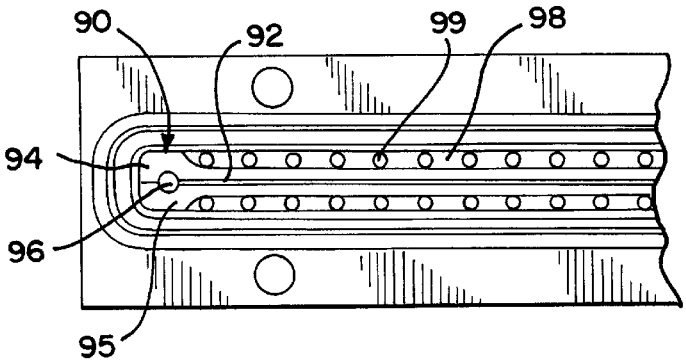
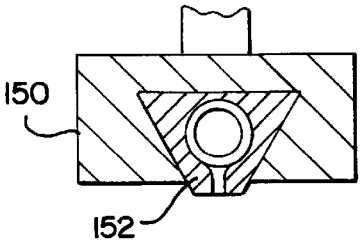
FIG. 9

GASSING RAIL APPARATUS AND METHOD

TECHNICAL FIELD

The invention relates to improved apparatus and method for exposing product, including food product, semiconductors, medical products and any product that has an adverse reaction to air, to a controlled environment. More particularly, this invention relates to improved apparatus and process for replacing air in product and/or containers with a desired controlled environment, including inert gas, combinations of gases and other aromas, mists, moisture, etc.

BACKGROUND OF THE INVENTION

Various products including food product, semiconductor products, medical products, and any other product that has an adverse reaction to air, are packaged in a controlled environment. Various attempts have been made to efficiently package these products in controlled environments using vacuum and/or controlled environments.

Various food products, including bakery goods, meats, fruits, vegetables, etc. are packaged under atmospheric conditions. Many of these products are presented in supermarkets, for example, in cartons or cardboard containers with a plastic or cellophane wrap covering the product.

One problem with this type of packaging is that the goods have a minimum limited shelf life, which for many products is only several days to a week. With bakery goods for example, mold may begin to grow after a few days under atmospheric conditions. Such products obviously cannot be sold or consumed and must be discarded.

Another problem arises with respect to many fruits and vegetables, which continue to ripen and continue their metabolic process under atmospheric conditions. For example, within a few days a banana can become overripe and undesirable to the consumer.

The space available for gassing operations is often limited at many facilities. In general, existing controlled environment systems are often expensive, bulky, and require three phase power, and, accordingly are impractical for use at many of these facilities.

In an effort to alleviate these problems, various attempts have been made to package food in a controlled environment by injecting controlled environment directly into filled containers. A high velocity flow is often necessary to penetrate into the food product. In general, these attempts have proved unsuccessful. With bakery goods, for example, the high velocity jets pull in air and re-contaminate the product, thereby failing to reduce the oxygen to levels that would prevent the normal onset of mold.

Various techniques for removing air in food filling processes are known in the art. Such processes are used, for example, in the packaging of nuts, coffee, powdered milk, cheese puffs, infant formula and various other dry foods. Typically, dry food containers are exposed to a controlled environment flush and/or vacuum for a period of time, subsequent to filling but prior to sealing. The product may also be flushed with a controlled environment prior to filling, or may be flushed after the filling process. When the oxygen has been substantially removed from the food contents therein, the containers are sealed, with or without vacuum Various techniques are also known for replacing the atmosphere of packaged meats products with a modified atmosphere of carbon dioxide, oxygen and nitrogen, and/or other gases or mixtures of gases to extend shelf life.

A gas flushing apparatus for removing oxygen from food containers is disclosed in U.S. Pat. No. 4,140,159, issued to Domke. A conveyor belt carries the open top containers in a direction of movement directly below a gas flushing device. The gas flushing device supplies controlled environment to the containers in two ways. First, a layer or blanket of low velocity flushing gas is supplied to the entire region immediately above and including the open tops of the containers through a distributing plate having a plurality of small openings. Second, each container is purged using a high velocity flushing gas jet supplied through a plurality of larger jet openings arranged side-by-side in a direction perpendicular to the direction of movement of the food containers. As the containers move forward, in the direction of movement, the steps of controlled environment blanketing followed by jet flushing can be repeated a number of times until sufficient oxygen has been removed from the containers, and from the food contents therein.

One aspect of the apparatus disclosed in Domke is that the flow of gas in a container is constantly changing. The high velocity streams are directed through perpendicular openings in a plate, which creates eddies near the openings causing turbulence which pulls in outside air. As a container moves past the perpendicular row of high velocity jets, the jets are initially directed downward into the container at the leading edge of the container's open top. As the container moves further forward, the flushing gas is directed into the center and, later, into the trailing edge of the open top, after which the container clears the row of jets before being exposed to the next perpendicular row of jets. The process is repeated as the container passes below the next row of jets.

The apparatus disclosed in Domke is directed at flushing empty containers and, in effect, relies mainly on a dilution process to decrease oxygen levels. One perpendicular row of jets per container pitch is inadequate to efficiently remove air contained in food product.

Constantly changing jet patterns in prior art devices create turbulence above and within the containers, which can cause surrounding air to be pulled into the containers by the jets. This turbulence also imposes a limitation on the speed at which the containers pass below the jets. As the containers move faster beneath the jets, the flow patterns within the containers change faster, and the turbulence increases. Also, at high line speeds, purging gas has more difficulty going down into the containers because of the relatively shorter residence time in contact with each high velocity row. The purging gas also has a greater tendency to remain in the head space above the containers. In addition, a perpendicular arrangement of jets relative to the direction of container travel causes much of the jet to be directed outside the containers, especially when the containers are round. Moreover, the spacing apart of the perpendicular rows may further vary the flow pattern and pull outside air into the containers.

The size of the container and container opening are also factors which may prevent adequate flushing and removal of existing environment inside the container. Medical bottles or viles which may contain medical liquids or powder, for example, antibiotics may have openings of less than ½ inch. To effectively remove the existing environment from these containers, existing gassing systems, for example, as disclosed in U.S. Pat. No. 4,140,159, issued to Domke, are not adequate. It may also be impracticable to use screened systems with widths which may be, for example, less than ⅙ inch.

It would be desirable to have a gassing system that would replace the air within empty and/or filled containers of various shapes and opening widths with a controlled environment of higher purity which would greatly increase the shelf life of the product.

SUMMARY OF THE INVENTION

One aspect of the invention provides an apparatus for exposing product to a controlled environment including a rail top, a rail base, and a gas limiting member. The rail top includes an inlet opening for receiving controlled environment gas from a source, and a channel region in communication with the inlet opening. The rail base is attached to the rail top and includes an open region to allow gas to exit. The gas limiting member is positioned in the channel and includes two longitudinally oriented sections which are fastened together through openings formed at each longitudinal end of the sections to provide a longitudinally oriented gap between the sections. A longitudinally oriented distribution baffle may be positioned within the channel region. The sections preferably include arcuate surfaces The sections may alternatively have a plurality of openings formed therein to allow gas flow through the sections. At least one gassing element may be positioned in the open region of the rail base.

Another aspect of the invention provides a method of exposing a product to a controlled environment while moving on a conveyor in a direction of travel, comprising the following steps. A gassing rail including a gas limiting member positioned along the conveyor is provided. The product is passed along the gassing rail for a period of time. A flow stream of gas is supplied through a longitudinally oriented gap formed between two sections of the gas limiting member oriented along the gassing element Alternatively, at least one gassing element positioned within the rail may be provided, and the sections of the gas limiting member may include a plurality of openings. A second flow stream may be supplied through the openings in the sections and through the gassing element.

Another aspect of the invention provides an apparatus for exposing product to a controlled environment including a rail base, a rail top, and a longitudinally oriented distribution baffle. The rail base has a length, width and thickness and includes at least one longitudinally oriented opening. The rail top has a length, width and thickness, and is attached to the rail base. The rail top includes at least one gas distribution opening and at least one channel region in communication with the gas distribution opening. The longitudinally oriented distribution baffle is positioned in the channel region of the rail top. A pair of O-rings including an inner O-ring and an outer O-ring may be preferably positioned around the perimeter of the channel. At least one gassing element may be positioned in the longitudinally oriented opening in the rail base, and the inner O-ring contacting the gassing element. A plurality of studs may preferably be welded to the rail base. The studs preferably have threaded openings for receiving screws. Preferably, at least one gassing element is positioned in the longitudinally oriented rail base opening, and the distribution baffle is aligned with the gassing element. The gas distribution opening may communicate with the channel region at one longitudinal end of the channel region.

Another aspect of the invention includes a method of operating apparatus for providing product with a controlled environment. A gassing rail including at least one longitudinally oriented gassing element, and a longitudinally oriented distribution baffle aligned with the gassing element is provided. Controlled environment gas is supplied at one longitudinal end of the baffle. The gas is distributed through the baffle along the length of the gassing element. The gas is flowed through the gassing element.

Another aspect of the invention provides an apparatus for exposing product to a controlled environment including a rail top, a rail base attached to the top rail top, and a port block including a T-shaped cross-section attached to the rail top. The port block may alternatively include a dovetail-shaped port block. The port block includes an inlet opening for receiving controlled environment gas from a source. A distribution opening may be formed in the port block and in communication with the inlet opening. The distribution opening preferably communicates with a channel region formed in the rail top. A bracket may be slidably attached to the port block. A threaded adjustment shaft may be attached to the bracket and to a mounting block, and a horizontal mounting shaft attached to the mounting block. A spring loaded plunger may fit into a groove formed in the threaded shaft for allowing adjustment. The rail base and rail top may preferably be fastened together with a plurality of screws which pass through openings formed in the rail top and are each received in one of a plurality of studs welded to the rail base.

The foregoing and other features and advantages of the invention will become further apparent from the following detailed description of the presently preferred embodiments, read in conjunction with the accompanying drawings. The detailed description and drawings are merely illustrative of the invention rather than limiting, the scope of the invention being defined by the appended claims and equivalents thereof.

BRIEF DESCRIPTION OF THE DRAWINGS

FIG. 5 is a bottom view of an alternative preferred embodiment of the rail top for use with containers with small openings;

FIG. 6 is a sectional view of the embodiment of FIG. 5;

FIG. 7 is a sectional view of an alternative preferred embodiment wherein the rail top and rail base are made of plastic; and FIG. 8 is a top view of an alternative preferred embodiment of the gas limiting member which includes a plurality of openings;

FIG. 9 is a sectional view of the dovetail-shaped port block and bracket.

DETAILED DESCRIPTION OF THE PRESENTLY PREFERRED EMBODIMENTS

Figure 1:
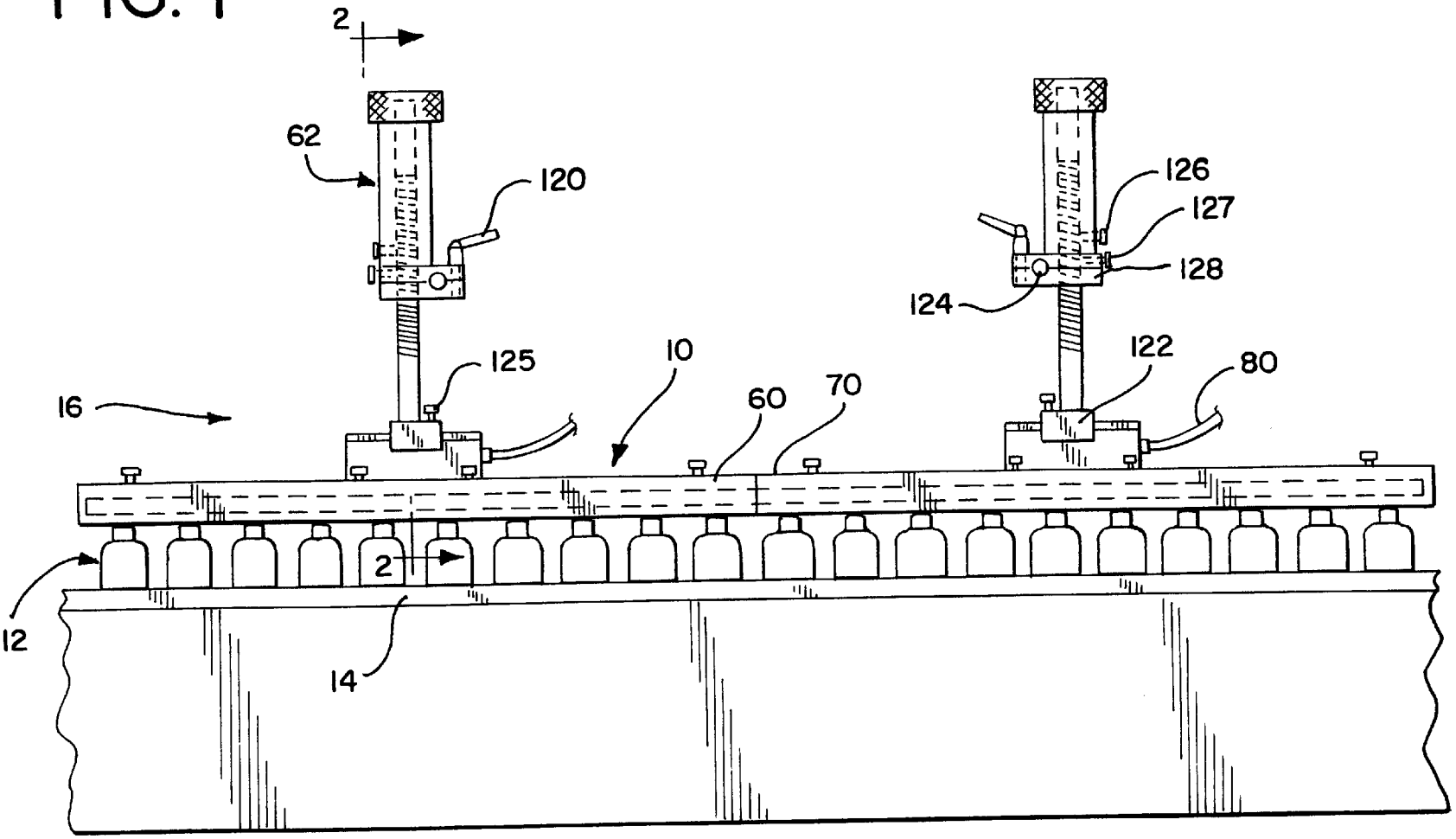
FIG. 1 is a side view of a preferred embodiment of the invention longitudinally disposed along a row of vials being transported by a conveyor.
Figure 2:
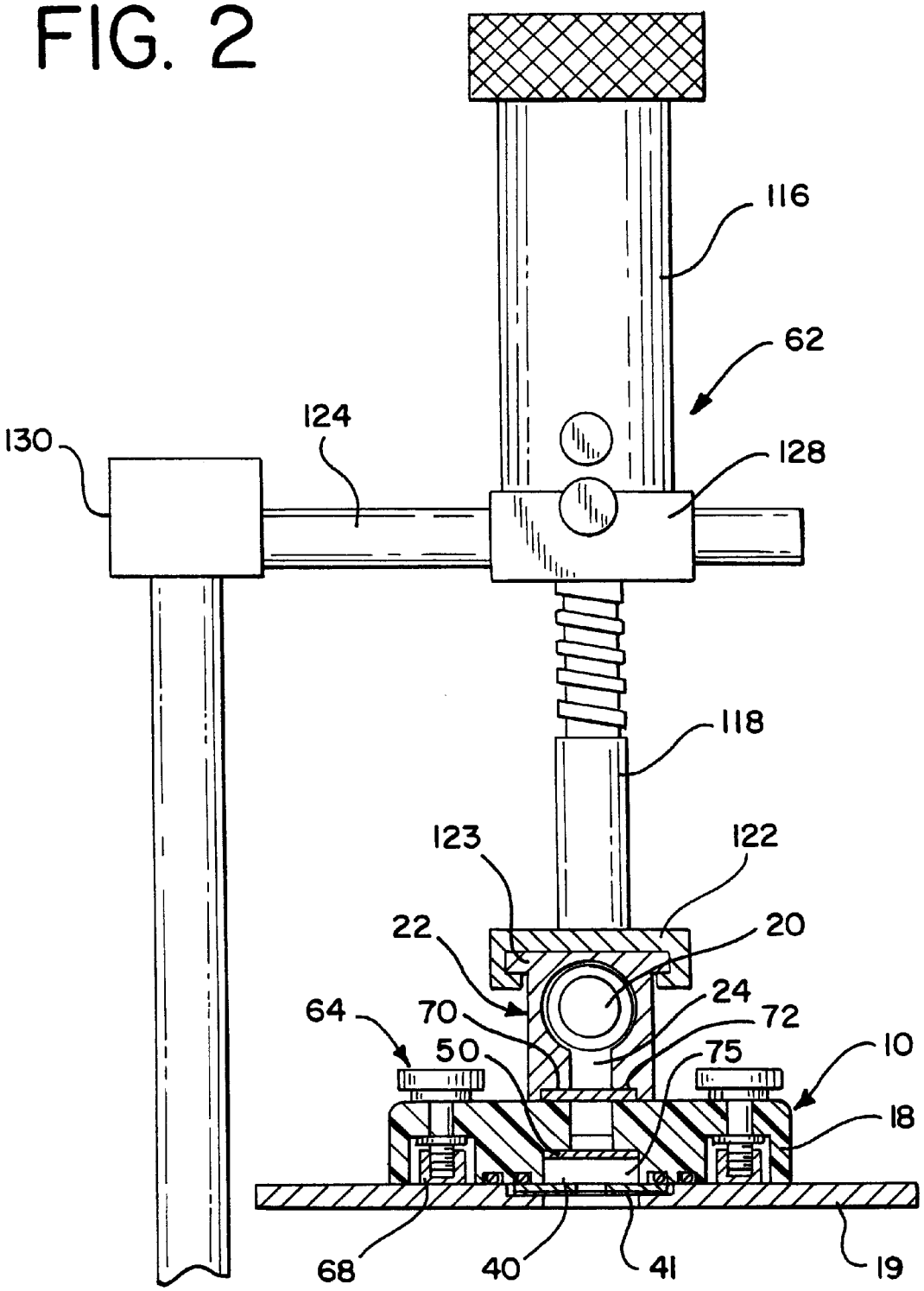
FIG. 2 is a is a sectional view taken through line 2—2 of FIG. 1.

Referring to FIGS. 1 and 2, a preferred embodiment of the gassing system is shown. The gas purging apparatus or gassing rail 10 is disposed along a row of containers with product 12 traveling on a conveyor 14 along rail 10 in a direction of travel designated by arrow 16. As shown in FIG. 2, gassing rail 10 includes rail top 18 and rail base 19, and gassing elements 40, 41. Although referred to herein as "rail top" and "rail base," it is contemplated that the rail 10 may be inverted or positioned in various configurations where the rail top 18 is not completely above the rail base 19. In the embodiment shown in FIG. 1, the rail 10 is composed of two 2 ft. sections 60, 70. Alternatively, sections of various lengths may be used and positioned in series to create the desired length of rail. For example, rail sections having a length of 3 or 4 inches may be combined with 2 ft. sections.

Figure 3:
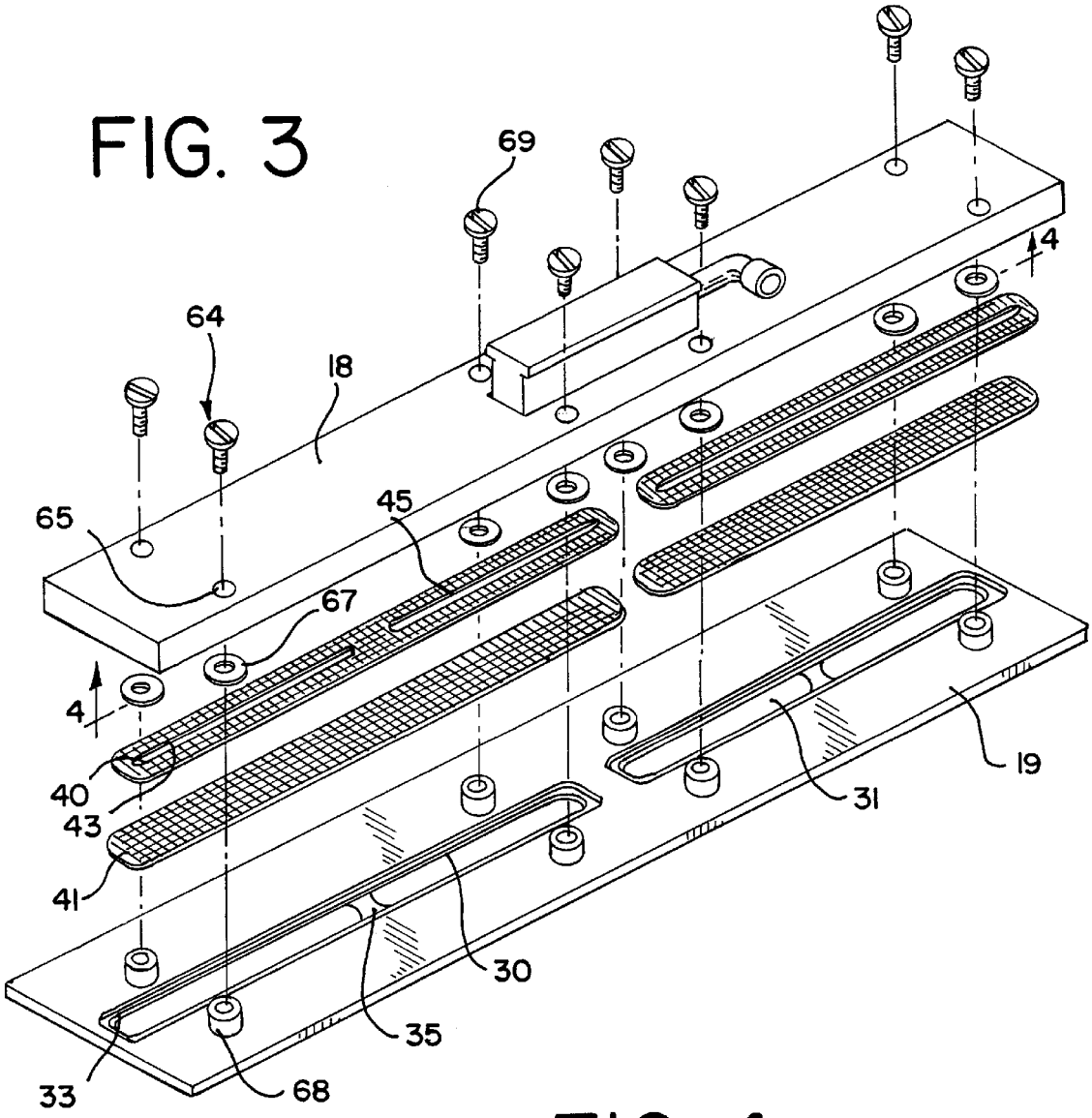
FIG. 3 is an exploded perspective view of a preferred gassing rail embodiment.

In the embodiment of FIGS. 1–3, one section of rail 10 includes a rail top 18 having a height of about 0.75 inch, a length of about 2 ft., and a width of about 3.0 inches. The rail top 18 is made of a rigid material. Preferably, for the embodiment shown in FIG. 3, the rail top 18 is made of plastic. The rail base 19 is also made of a rigid material, preferably stainless steel or aluminum. In the embodiment of FIG. 3, the rail base 19 preferably has a height or thickness of 0.188 inch, a width of about 3.0–8.0 inches, and a length of 2 ft. The reduced thickness is made possible in this embodiment by the use of stud welds which are studs 68 welded to the top surface of the rail base 19. The use of stud welds also eliminates the need for screw holes formed through the rail base, which tend to collect product particles during use. The bottom surface of the base 19 remains an unbroken smooth surface except for the open regions 30, 31. The studs 68 include threaded openings to receive thumb screws 64, which are inserted through openings 65 formed in the rail top and retained with retaining washers 67. The studs 68 and rail top openings 65 are, for the preferred embodiment shown, are spaced in pairs along the rail 10. The thumb screws 64 are preferably knurled and have slots 69, which are adapted to receive a screwdriver and/or coin to allow easy assembly and disassembly of the rail 10.

Alternatively, as shown in FIG. 7, the rail base 17 may be made of plastic. Plastic or other non-metal rails are necessary in gassing systems which include metal detection to monitor container movements When plastic is used it is preferable that the thickness of the rail base 17 be increased to allow screw holes 13 to be bored into the rail base without penetrating the bottom surface of the rail base.

Figure 4:
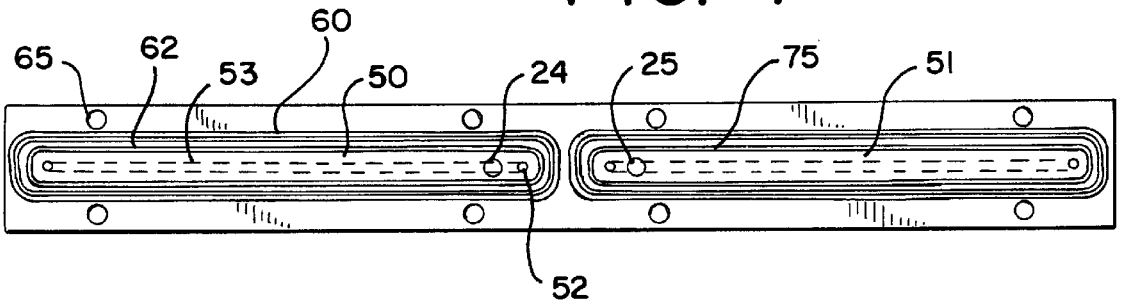
FIG. 4 is a bottom view of a preferred embodiment of the rail top.

The rail top 18, for the embodiment shown in FIGS. 2–4, has a longitudinally oriented channel region 75 formed therein for receiving a distribution baffle 50. For the embodiment shown the channel region 75 is approximately 10.578× 0.719 inches. The distribution baffle 50 which form fits to the channel, may for example be made of 5-ply, 75 micron stainless steel mesh. As shown in FIG. 2, a recessed region (shown in phantom line) 53 formed in the rail top along the channel region 75, may, for the embodiment shown, have measurements of 9.75×0.187 inches The channel region 75 may have a depth of, for example, about 3/16 inch and the recessed region 53 of an additional 1/16 inch. One end of the recessed region 53 is preferably aligned with the distribution openings 24, 25. The recessed region 53 allows the incoming gas to be distributed along the length of the distribution baffle 50.

Positioned around the perimeter of the channel region 75 is a pair of O-rings, which include outer O-ring 60 and inner O-ring 62. The outer O-ring 60 preferably seals against the surfaces of the rail top 18 and rail base 19 to prevent controlled environment gas from leaking The inner O-ring 62 is aligned to press against the gassing element 40, for the embodiment shown. This secures the gassing elements 40, 41 in place, and prevents any movement of these gassing elements during operation to maintain a consistent flow.

As shown in FIGS. 5–6 a gas limiting member 90 includes two longitudinally oriented sections 94, 95. The sections 94, 95 have dimensions to fit within the channel 75 with the distribution baffle 50 in place. A gap 92 may be precisely preset using shim stock. The sections 94, 95 include openings 96, 97 at their longitudinal ends, which allows the sections 94, 95 to be fastened together using a bolt or other conventional fastener to provide the desired preset gap width. Medical flasks, for example, which may have openings of ½ inch may be provided with a preferred velocity flow stream by adjusting the gap 92, for example, to ⅛ inch. The gas limiting member 90 may be operated within a rail with or without one or more gassing elements. Each section 94, 95 preferably has an arcuate surface 98, which aids in reducing turbulence as the gas passes through the narrow gap 92. Alternatively, as shown in FIG. 8, openings 99 may be formed through each of the sections 94, 95 to allow the gas to pass directly through gassing elements 40, 41 and provide lower velocity flows on either side of the higher velocity flow which passes through the gap 92. Using the gassing element configuration shown in FIG. 3, the gas passing through the gap 92 would pass through slots 43, 45 of gassing element 40 and through gassing element 41. Various other gassing element configurations may be used to achieve the desired resistance and exit flow velocity. For flasks having a height of 6 inches and an opening of ½ inch, one preferred embodiment provides for the higher velocity flow region having a ⅛ inch width, and a lower velocity flow regions having a ⅛ inch on both longitudinal sides of the higher velocity flow region.

Rail 10 should preferably be at least as wide, and more preferably somewhat wider, than the product or container opening. Rail 10 may also be narrower than the product or container opening, but under certain conditions this may allow outside air to contaminate the product and/or container. Structure or other means may be combined with the narrower rail to maintain the controlled environment. The length of the rail may vary depending on the desired line speed and minimum residence time underneath rail 10 for each container or product 12. Also, a plurality of rail sections may be arranged lengthwise in series to create a greater "effective" length. The actual length or number of rail sections required will depend on various factors, including conveyor speed, container and product volume, and product type.

For a given residence time, the maximum line speed increases as the length of rail 10 is increased. For the embodiment described above, a preferred line speed for gassing, for example, most bakery products is approximately 120 containers per minute (which have, for example, a length of 6 inches, a width of 3.5 inches and a depth of 2.5 inches) (80 ft. per minute of conveyor speed) and requires approximately 16 ft of effective rail length.

The controlled environment gas enters from inlet tube 80 through the opening 20 formed in the port block 22. As shown in FIG. 2, port block opening 20 communicates with distribution opening 24. For the embodiment shown in FIG. 4, two distribution openings 24, 25 are perpendicular to the port block opening 20, and allow the controlled environment gas to pass through to the distribution baffles 50, 51. A port block baffle 70 may also be positioned across the distribution opening 24 in a recessed area near the base of the port block 22. The port block baffle 70 may also, for example, be made of 5-ply 75 micron stainless steel mesh, and may act as a filter. The port block 22 is preferably attached to the rail top 18 with screws or other conventional fasteners inserted through openings 52, which also secure the distribution baffle 50 to the top rail 18. O-ring 72 prevents any leakage of gas between the port block 22 and the rail top 18.

The gassing elements 40, 41 are positioned in the longitudinally oriented openings 30, 31 of the rail base 19.

Around the longitudinally oriented openings 30, 31 are rims 33 which aid in supporting the gassing elements 40, 41. In the embodiment of FIGS. 2–4, each of the open regions 30, 31 include bridge region 35 to further support the gassing elements 40, 41. For that embodiment the gassing elements have a length of about 11.25 inches and a width of about 2.187 inches. The open regions 30, 31 are of the same length and width, and include a ¼ inch rim 33 and a ¼ inch bridge region 35.

For the embodiment of FIG. 3, top gassing element 40 is preferably formed from a five-ply wire screen having a hole size of between about 10–100 microns. The top gassing element 40 has two 4.875×0.25 inch slots 43, 45 formed therein. The bottom screen 41 is preferably formed from a 2-ply wire screen having a hole size of preferably 80 microns. The gas limiting member 90, shown in FIGS. 5, 6 and 8, may be used with one or both screens to provide higher velocity flow surrounded by lower velocity flow.

For the embodiment of FIGS. 2–4, for example, the 2 ft. section of rail may have an inlet and an outlet flow rate of about 1 to about 7.5 cubic ft. per minute. The optimum controlled environment flow rate will vary depending on the line speed, product and/or container dimensions The height adjusting apparatus 62 provides the operator an efficient means of lowering the rail 10 to a desired level from various sized packages and products. It also allows the rail 10 to be quickly removed for cleaning. The adjusting members 62 each include adjustment knob 116, vertical threaded shaft 118, horizontal mounting shaft 124, port block bracket 122, and mounting block 128. For the embodiment of FIGS. 1 and 2, the horizontal mounting shaft 124 may be made of a 12 inch long, 0.750 inch diameter shaft of stainless steel. One and of the horizontal mounting shaft is connected to a support member 130, which may be in contact with the floor, or be secured to a rigid structure. Horizontal mounting shaft 124 slidably fits within an opening formed in mounting block 128, which is also preferably made of stainless steel. Horizontal adjusting handle 120 is used to secure the shaft 124 to mounting block 128, and may be turned to allow the mounting block 128 and thus the rail 10 be moved in a horizontal direction to an optimal alignment with the conveyor 14 and product 12. Vertical threaded adjusting shaft 118 is screwably received within adjusting knob 116, and fastened to mounting block 128. Shaft 118 is preferably fastened to port block bracket 122 which is slidably fastened to rail 10. The port block bracket 122 is designed to interface with a top portion 123 of the port block 22. Preferably, as shown in FIG. 2, the port block 22 has a T-shaped cross-section and the port block bracket 122 slidably attaches to the top portion 123 of the port block 22. Alternatively, the port block may be configured to slidably interface with the port block bracket in various other configurations, including, for example, the bracket 150 and dovetail-shaped port block 152 shown in FIG. 9 includes an adjusting screw 125. The adjusting screw 125 may be loosened to allow the rail 10 to be slid horizontally to a desired position. When the adjusting screw 125 is tightened, the rail 10 is prevented from moving, and the vertical adjustments may be made to achieve the appropriate distance between the rail and container and/or product. Plunger 126, which is preferably spring-loaded, may be pulled horizontally outward from its engagement with a groove formed in shaft 118 to allow the operator to make major vertical adjustments to the rail position. The thumb screw 127 may be used to tighten the mounting block 128 and adjusting knob 116. Fine tuning the rail 10 to the precise position from the container or product 12 may be accomplished by turning adjustment knob 116. For the embodiment of FIG. 1 and 2, adjusting knob 116 is preferably made of delrin, and is 6.125 inches long with a 4.625 inches long, 1.860 diameter center portion, a 1 inch, 2.5 inch diameter cap portion, and a 0.5 inch, 1.174 inch grooved portion which is received in an opening formed in the mounting block 128. Vertical threaded shaft 118 is preferably made of stainless steel and has a length of 6 inches with an upper grooved portion having a length of 4.75 inches. The shaft 118 has an outer diameter of 0.75 inch, with 0.125 inch deep by 0.165 inch wide grooves, which are spaced to provide 3 grooves per inch. Preferably, the grooves have a rectangular shape.

Preferably, the vertical distance between the bottom of the rail 10 and the product or container 12 is small, and should not exceed about ⅜ inch.

Sidewalls may be used. The sidewalls aid in preventing outside air from entering the purging area, and increase the efficiency of the system. The sidewalls also act to force the gas, which includes the air flushed from the container and/or product and controlled environment to exit through the entrance, where the gas may be collected.

While the embodiments of the invention disclosed herein are presently considered to be preferred, various changes and modifications can be made without departing from the spirit and scope of the invention. The scope of the invention is indicated in the appended claims, and all changes that come within the meaning and range of equivalents are intended to be embraced therein.

We claim:

1. An apparatus for exposing product to a controlled environment comprising:

an elongated rail top including an inlet opening formed therein for receiving controlled environment gas from a source, and a elongated and longitudinally oriented channel region formed therein in communication with the inlet opening;

an elongated rail base attached to the rail top, the rail base including an elongated and longitudinally oriented open region to allow gas to exit; and an elongated and longitudinally oriented gas limiting member positioned in the elongated and longitudinally oriented channel region, the gas limiting member including two longitudinally oriented sections positioned in the channel region, the sections being fastened together through openings formed at each longitudinal end of the sections to provide a longitudinally oriented gap between the sections, the gas limiting member having a length substantially the same as a length of the channel.

2. The apparatus of claim 1 further comprising a longitudinally oriented distribution baffle positioned within the channel region.

3. The apparatus of claim 1 wherein the sections include arcuate surfaces.

4. The apparatus of claim 1 wherein the sections have a plurality of openings formed therein to allow gas flow through the sections.

5. The apparatus of claim 1 further comprising at least one gassing element positioned in the open region of the rail base.

6. A method of exposing a product to a controlled environment while moving on a conveyor in a direction of travel, comprising the steps of:

providing an elongated and longitudinally oriented gassing rail including a rail base attached to a rail top, the base including an elongated and longitudinally oriented open region to allow gas to exit, the top including an elongated and longitudinally oriented gas limiting member positioned in an elongated and longitudinally oriented channel region formed in the gassing rail top, the gas limiting member including two longitudinally oriented sections fastened together through openings formed at each longitudinal end of the sections to provide a longitudinally oriented gap between the sections, the gas limiting member having a length substantially the same as a length of the channel;

passing the product along the gassing rail for a period of time; and supplying a stream of gas through the longitudinally oriented gap.

7. The method of claim 6 further comprising:

providing at least one gassing element within the rail, the sections of the gas limiting member including a plurality of openings formed therein; and supplying a second flow stream through the openings in the sections and through the gassing element.

8. An apparatus for exposing product to a controlled environment comprising:

a rail base having a length, width and thickness, the rail base including at least one longitudinally oriented opening formed therein;

an elongated rail top having a length, width and thickness attached to the rail base, the rail top including at least one longitudinally oriented gas distribution opening and at least one longitudinally oriented channel region in communication with the gas distribution opening formed therein, the channel region having a length substantially the same as a length at the gas distribution opening; and a longitudinally oriented distribution baffle positioned in the channel region, the distribution baffle having a length substantially the same as the length of the channel region.

9. The apparatus of claim 8 further comprising a pair of O-rings including an inner O-ring and an outer O-ring positioned around the perimeter of the channel.

10. The apparatus of claim 9 further comprising at least one gassing element positioned in the longitudinally oriented opening in the rail base, the inner O-ring contacting the gassing element.

11. The apparatus of claim 8 wherein the rail base includes a plurality of studs welded thereto, the studs having threaded openings for receiving screws.

12. The apparatus of claim 8 further comprising at least one gassing element positioned in the longitudinally oriented rail base opening, the distribution baffle aligned with the gassing element.

13. The apparatus of claim 8 wherein the gas distribution opening communicates with the channel region at one longitudinal end of the channel region.

14. A method of operating apparatus for providing product with a controlled environment comprising:

providing an elongated gassing rail including an elongated longitudinal opening, at least one longitudinally oriented gassing element covering the opening, and a longitudinally oriented distribution baffle aligned with the gassing element, the distribution baffle having a length substantially the same as a length of the gassing element;

supplying controlled environment gas at one longitudinal end of the baffle;

distributing the gas through the baffle along the length of the gassing element; and flowing the gas through the gassing element.

15. An apparatus for exposing product to a controlled environment comprising:

an elongated rail top including an inlet opening formed therein for receiving controlled environment gas, and a longitudinally oriented channel region;

an elongated rail base attached to the rail top, the rail base including a longitudinally oriented open region to allow the controlled environment gas to exit, the open region having a length substantially the same as a length of the channel region; and a port block for slidably connecting to a bracket, the port block including a bottom surface seated upon and attached to a top surface of the rail top, said port block having an inlet opening formed therein for receiving controlled environment gas from a source.

16. The apparatus of claim 15 further comprising a distribution opening formed in the port block and in communication with the inlet opening.

17. The apparatus of claim 16 wherein the distribution opening communicates with a channel region formed in the rail top.

18. The apparatus of claim 15 further comprising a bracket slidably attached to the port block, a threaded adjustment shaft attached to the bracket and to a mounting block, a horizontal mounting shaft attached to the mounting block.

19. The apparatus of claim 18 further comprising a spring loaded plunger which fits into a groove formed in the threaded shaft for allowing adjustment.

20. The apparatus of claim 18 wherein the rail base and rail top are fastened together with a plurality of screws which pass through openings formed in the rail top and are each received in one of a plurality of studs welded to the rail base.

21. The apparatus of claim 15 wherein the port block has a T-shaped cross-section.

22. The apparatus of claim 15 wherein the port block has a dovetail-shaped cross-section.

23. An apparatus for exposing product to a controlled environment comprising:

a rail top;

a rail base attached to the rail top;

a port block including a T-shaped cross-section attached to the rail top, said port block having an inlet opening formed therein for receiving controlled environment gas from a source;

a bracket slidably attached to the port block;

a threaded adjustment shaft attached to the bracket and to a mounting block;

a horizontal mounting shaft attached to the mounting block; and a spring loaded plunger which fits into a groove formed in the threaded shaft for allowing adjustment.

24. An apparatus for exposing product to a controlled environment comprising:

a rail base having a length, width and thickness, the rail base including at least one longitudinally oriented opening formed therein;

a rail top having a length, width and thickness attached to the rail base, the rail top including at least one gas distribution opening and at least one channel region in communication with the gas distribution opening formed therein;

a longitudinally oriented distribution baffle positioned in the channel region;

a pair of O-rings including an inner O-ring and an outer O-ring positioned around the perimeter of the channel; and at least one gassing element positioned in the longitudinally oriented opening in the rail base, the inner O-ring contacting the gassing element.

* * * * *